United States Patent [19]

Gutmann, Jr.

[11] 4,049,331

[45] Sept. 20, 1977

[54] WORK DESK CONSTRUCTION

[75] Inventor: Karl Gutmann, Jr., Unterkirnach, Germany

[73] Assignee: Karl Gutmann KG., Germany

[21] Appl. No.: 710,367

[22] Filed: Aug. 2, 1976

[30] Foreign Application Priority Data

Aug. 16, 1975 Germany ..... 2536460

[51] Int. Cl.[2] ..... A47B 53/00; A47B 87/00

[52] U.S. Cl. ..... 312/203; 312/196; 312/198; 312/195; 108/64

[58] Field of Search ..... 312/194, 198; 108/64, 108/66, 69

[56] References Cited

U.S. PATENT DOCUMENTS

| | | | |
|---|---|---|---|
| 57,075 | 2/1921 | Fox | 312/196 UX |
| 2,489,933 | 11/1949 | Schwartz | 108/64 |
| 2,545,253 | 3/1951 | Bergson | 312/195 X |
| 3,082,712 | 3/1963 | Trautman et al. | 108/64 X |
| 3,339,503 | 9/1967 | Flodell | 108/64 |
| 3,437,390 | 4/1969 | Evans | 312/196 |
| 3,964,401 | 6/1976 | Gutmann et al. | 312/198 |

*Primary Examiner*—Paul R. Gilliam
*Assistant Examiner*—Victor N. Sakran
*Attorney, Agent, or Firm*—McGlew and Tuttle

[57] ABSTRACT

A work desk construction, particularly for typists, comprises one or more subassemblies which includes a longitudinally extending rectangular first support frame which is interconnected with a second and third transversely extending frame which extend out to respective opposite sides of the longitudinal frame. Each transverse frame includes end frame members which extend through the adjacent slide frame member of the longitudinal frame and are connected to the opposite side frame member. The frame structure is supported by legs which extend downwardly from the outer lateral ends of the transverse frames and they provide the sole support for the structure. A box-like case of substantially the same size as the longitudinal frame is supported directly on the frame and it advantageously includes compartments which open laterally at respective opposite sides of the longitudinal frame member adjacent each end thereof. The transverse frame members are covered by desk plates at the portions thereof which extend outwardly from the longitudinal frame. The longitudinal frame is also advantageously provided with a cross-member at each end in the form of an angle bar having means for interconnecting adjacent ends of a plurality of subassemblies into a long unit.

12 Claims, 5 Drawing Figures

A
A
3
4
5
8
9
10
11
12
13
14
15
20
22
23
28
29
30
32
33

WORK DESK CONSTRUCTION

FIELD AND BACKGROUND OF THE INVENTION

This invention relates in general to the construction of classroom, typing and similar desks and, in particular, to a new and useful work desk which comprises a subassembly which includes a longitudinally extending support frame forming a base for a box-like case and a transversely extending support frame connected into the longitudinal frame from respective opposite sides and adjacent respective opposite ends and which are adapted to be covered by desk plates which extend laterally from the central box-like case and wherein the entire assembly is supported by vertical legs which are secured to the outer ends of the transverse frames.

DESCRIPTION OF THE PRIOR ART

The present invention deals particularly with assemblies of desks, for example, of the type which are used in a classroom particularly for typing classes. At the present time, assemblies of individual desk units which form a row of working places for typewriting is known, and these units include legs which are centrally provided not only on each of the longitudinal bars of metal tube frames of the work desk but also on each of the cross-bars of the rectangular frame in order to give the row of working places thus formed the necessary stability and particularly to give it load-carrying capacity. With the known typewriter working places of the prior art, the intention is to make it possible to use the units individually after removing the typewriter desk which is detachably secured to the rectangular support frame and, at the same time, to use the desk in an assembly in which it forms an element in a row of working places. It is possible to form the row of working places both with the typewriter desks which are provided at either side in alternately offset positions and with desks which are disposed only at one side of the table strip. For reasons of stability, however, it is absolutely necessary in such a construction of the prior art to provide both the metal tube frames of the typewriter desk and also the rectangular frame of the table strip element with legs so as to have at least three legs for each working place of a row which is provided with desks unilaterally and with at least four legs for each working place of a row being provided with desks bilaterally. In practice, experience has shown that the legs provided below the rectangular frame of the table strip make it difficult to clean under such devices and also make it difficult to install such a row of working places particularly where floors are uneven. In addition, the legs are troublesome for the students since they restrain the free space below the table strip.

In a further known construction, rows of working places are formed in which the table strip is designed as a separate structural unit and it is manufactured in its entire length corresponding to the number of typewriter desks which are to be employed and is installed in one piece. In such rows of working places, it is possible to reduce the number of legs necessary for the table strip to a minimum. As a rule, however, the legs have to be spaced from each other by approximately two meters since otherwise the construction would require a very heavy frame structure in order to provide the necessary stability. The main disadvantage of these constructions is that they always must conform to the required number of working places, that is, they must be individually designed in manufacture. In addition, because of their length which usually exceeds five meters, it is very difficult to provide storage for them. Also, it is necessary to make the long metal frame with longitudinal bars having stronger cross-section than in cases where the row is assembled of individual elements.

Another known design includes a construction in which connecting rods or tubes are used to interconnect two or more frames of lined-up tables together which can be fitted into the end portions of the longitudinal and cross-bars of the frame and the legs of the tables are provided with braces which support the bar. In this known construction, which comprises a square-shape table and a metal plate with a frame rectangularly bent around the plate and folding legs hinged to the frame, rectangular recesses are provided for receiving the connecting rods. The connecting rods serve only for securing the horizontal position since the tables to be lined-up are provided with legs at each corner. The braces which are provided between the legs and the bars comprise each two rod lengths hinged to each other and they are necessary for retaining the swung-down legs in their supporting position. The connecting rods or tubes are not intended for producing a stable supporting connection between the individual table plates and the used braces do not serve the purpose of saving supporting legs.

Another known construction comprises an office desk combined with a typewriter desk which is joined to the office desk at a right angle thereto and in which the frames of the two desks are made of rectangular metal tubes and they are superimposed crosswise. The table plate of the typewriter desk is secured to the metal frame which is mounted below the rectangular frame of the office desk by means of an adjusting device. Aside from the fact that the two metal frames are superimposed and, consequently, their vertical dimensions add, this arrangement is not suitable for increasing the torsional stiffness or the static stability and loadcarrying capacity of the frame structure and, thereby, does not make it possible to save on the number of supporting legs. The known office desk is provided at each end of its corners with one supporting leg and the typewriter desk which is equipped with a lower case and extends transversely thereto is provided with two legs at its outside.

REFERENCE TO ISSUED PATENT

The present invention is an improvement over applicant's U.S. Pat. No. 3,964,401 dated June 22, 1976 principally in the construction of a unit which includes the row of working places which may be formed of individual members which comprise each a narrow central part extending in the longitudinal directions and two lateral desks secured in offset position at opposite sides to the central part and which are connected to each other by a firmly assembled framework in a manner such that each individual member of the row needs to be supported by only two legs which are provided at the longitudinally extending outer lateral edges of the side desks.

SUMMARY OF THE INVENTION

The present invention provides a unit desk construction or an assembly of desks which is made up of individual units which may be easily interconnected and which are constructed to provide for the maximum desk supporting stability and the minimum number of supporting legs. The subassembly is particularly for typewriting and it is suitable for interconnection with a similar subassembly to form a row of working places in a structure which offers a maximum of stability while requiring minimum expenses of constructional means and shapes to an extent such that it becomes sufficient to provide legs for the row of working places to be formed only at the outside of each of the working desks which are arranged to extend transversely to respective alternate opposite sides along the length of the central longitudinal desk.

In accordance with the invention, the subassembly or unit includes a longitudinally elongated rectangular frame and a transverse frame connected into each side of the rectangular frame adjacent each respective end, preferably in a manner such that the laterally elongated transverse frame members at each end extend through one longitudinally extending side frame member of the longitudinal frame and are secured thereto and to the opposite side frame of the longitudinal frame member. The frame assembly of the longitudinal and two transverse frames are supported by legs which are connected to the outer transverse ends of the transverse frames. At least the longitudinal side frame members of the transverse frames are made hollow so as to permit insertion of connecting rods therein for joining to a next adjacent frame member. In addition, or alternatively, each longitudinal frame member includes a transverse end part in the form of an angle member having openings therethrough for both holes which may be aligned with adjacent units to facilitate the bolting of the units together. Advantageously, a box-like case of the same shape as the longitudinal frame unit is supported directly over the frame unit and desk plates are supported over the portions of the transverse frame units which extend laterally on each side of the longitudinal frame. The box-like case advantageously includes a side opening formed at a location alongside the portion of the longitudinal frame which is free of the transverse frame.

The invention provides an individual unit structure which is substantially more stable and stronger than the prior art structures and which provides an exceptional loadcarrying capacity and high stability. In addition, each subassembly or unit of the row of working places may be secured to a similar unit in a longitudinal extension of the units. Each unit requires only two supporting legs which may be spaced apart by the greatest transverse span and which may be located directly beneath the respective outer longitudinal frames which support the desk plates upon which the typewriters or similar elements may be located. Supporting legs may be of any suitable shape, such as U-shape or L-section instead of the rectangular or square ones required by the prior art. In addition, in order to give the individual subassemblies a certain steadiness, and thereby to facilitate their assembly, it is advantageous to provide the legs with longitudinally extending foot bars adjacent their lower ends. It is also possible, of course, to provide two legs on an outer cross-member of each transverse frame instead of a single leg. The whole subassembly may be connected to a similar subassembly or unit by merely bolting the two units together by bolts passed through openings at transverse end members of each longitudinal frame. This interconnection provides a substantially higher stability between the individual subassemblies with respect to both vertically and horizontally acting forces.

In a preferred arrangement of the invention, the transverse frame members comprise a transverse member at one end which is made of double width so that it presents a flat top surface which is elongated in a longitudinal direction. This frame member as well as the other one is welded into the side frame elements of the longitudinal frame. The wider side of the end member of the transverse frame is oriented substantially horizontally and provides a means for distributing both supporting load as well as torsionally acting stresses very satisfactorily. In addition, it provides a very good surface for the support of the desk plate which supports the typewriter.

With the prior art construction where rectangular tubes are employed throughout in an upright position in order to obtain a better vertical stability, there is no suggestion of any increase of horizontal stability in the longitudinal direction of the row of working places. In contrast thereto, the design of the present invention wherein transverse frames are connected into and fastened to a central longitudinal frame, there is an increase in overall stability and there is effected a construction which makes it possible to eliminate central legs in the range of the longitudinally extending central table. The construction also ensures against deformation of the parts and twisting and ensures that the assembly provides a secure operating support.

Accordingly, it is an object of the invention to provide an improved work table construction which includes a central longitudinal support frame member of a size to support a box-like case thereon of similar size and which is interconnected at a spaced location from each end by transverse frame members which extend laterally outwardly to each respective side at offset locations and which includes a support leg connected to the outer lateral ends of each transverse frame member which comprise the sole support for the unit and wherein the unit is advantageously provided with end elements at each end of the longitudinal frame which permits them to be interconnected with another element of similar structure.

A further object of the invention is to provide a work table construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a perferred embodiment of the invention.

DESCRIPTION OF THE PREFERRED EMBODIMENTS

Figure 1:
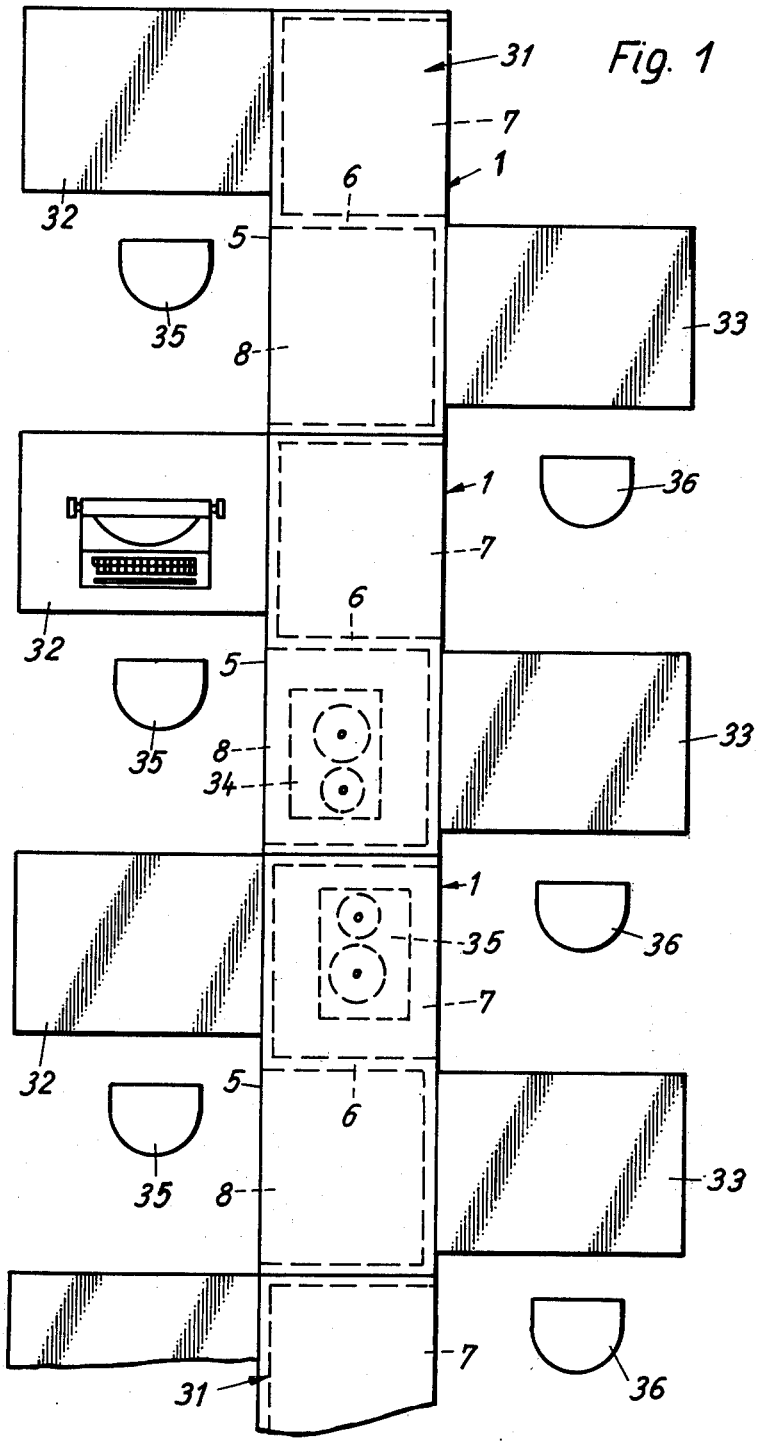
FIG. 1 is a top plan view of an assembly of work desk units constructed in accordance with the invention.
Figure 2:
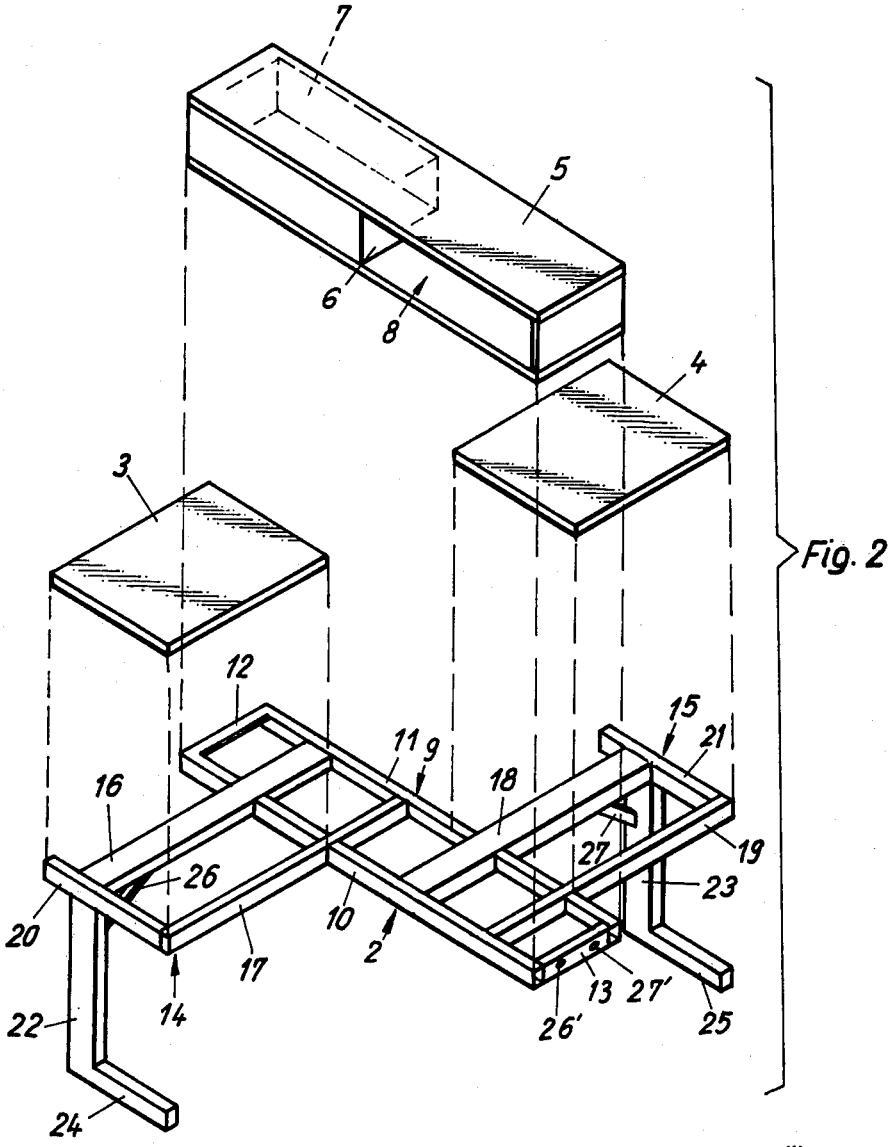
FIG. 2 is a partial exploded perspective view of a single work desk construction.

Referring to the drawings in particular, the invention embodied therein in FIGS. 1 to 5 comprises individual units or subassemblies which, as best seen in FIG. 2, include a desk support frame work, generally designated 2, which provides a supporting base for respective desk plates 3 and 4 which are arranged on each lateral side of a central longitudinally elongated box-like case 5 which is secured to the central portion of the framework 2. In accordance with a feature of the invention, framework 2 comprises a longitudinally elongated central frame 9 which is interconnected by transversely elongated frames 14 and 15 which extend into the longitudinal frame from respective opposite sides at offset locations along the length of the longitudinal frame. When the box-like case 5 is fitted over the longitudinal frame 9, a partition 6 divides the case 5 into a compartment 7 and a compartment 8. Compartment 8 opens into the space which does not contain the transverse frame 14 and compartment 7 opens on the side which is alongside the space which is not occupied by the transverse frame 15.

Figures 3, 4, 5:
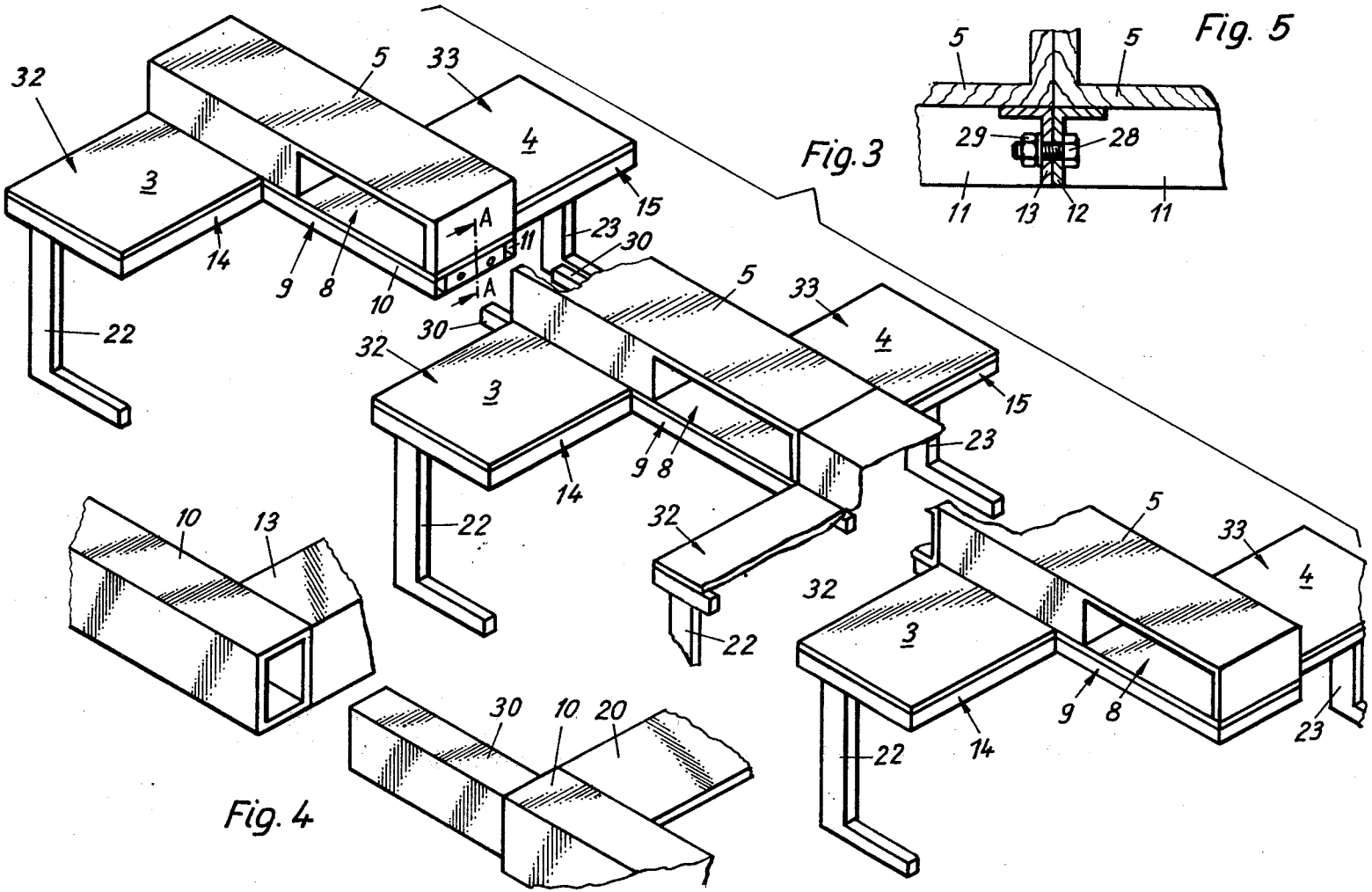
FIG. 3 is a top lateral exploded perspective view indicating the interconnection of the individual units into a desk assembly.
FIG. 4 is an enlarged partial perspective view of the plug connection of two longitudinal frames of each desk unit.
FIG. 5 is an enlarged partial sectional view taken along the line A—A of FIG. 3.

The longitudinal frame 9 comprises a narrow, longitudinally elongated frame made up of two longitudinally extending side bars 10 and 11 which comprise rectangular metal tubes having ends open at each end. A transverse end member or angle bar 12 extends between the side members 10 and 11 at the respective ends and it is welded thereto in a manner to position the angle members so that their flat ends extend vertically and their flat upper faces extend horizontally inwardly from the adjacent ends of the subassembly so as to provide a supporting face for receiving the box-like case 5 as shown in FIG. 5. The angle bars are welded at each end to the respective side members 10 and 11 and the whole rectangular frame 9 serves for the purpose of supporting the box-like case 5. Both the case 5 and the frame 9 have the same horizontal dimension so that they are flush with each other.

Each of two oppositely directed lateral metal tube frames 14 and 15 serve as supports for desk plates 3,4. Frames 14 and 15 comprise two spaced apart parallel cross-bars 16, 17 or 18, 19, and a longitudinal bar 20 or 21. Each of cross-bars 16, 17, 18 and 19 extends through the frame 9 and the cross-bars are arranged so that the pairs of bars from each side extend across one of the longitudinal bars 10 or 11 of frame 9. In the longitudinal direction of frame 9, one pair of cross-bars overlaps the other by the width of frame 9. The two cross-bars 16, 17 of lefthand metal tube frame 14 cross left longitudinal bar 10 and abut the inside of longitudinal bar 11, while the two cross-bars 18, 19 of right metal tube frame 15 cross right longitudinal bar 11 and abut the inside of left longitudinal bar 10. At all corners produced by the rectangular abutting of two vertical surfaces, cross-bars 16, 17, 18 and 19 are welded to longitudinal bars 10, 11 of frame 9. Longitudinal bars 20, 21 of metal tube frames 14 and 15 are also welded to cross-bars 16 and 17 or 18 and 19. While cross-bars 17 and 19 have the same cross-section as longitudinal bars 10 and 11 of frame 9 and longitudinal bars 20, 21 of metal tube frames 14, 15 are also positioned so that their narrow surfaces extend in the horizontal plane. Each of the cross-bars 16 and 18 has a rectangular cross-section in which the narrow sides correspond to the wide sides of the cross-sections of the other tubes and the wide sides correspond approximately to double the width of the narrow side and are positioned so that their wide sides extend in the horizontal plane. It is to be noted that, considered in the transverse direction of frame 9, the cross-bars which are disposed at the outside, namely, 16 and 19, are each spaced from the ends of rectangular frame 9. The purpose thereof is both to obtain statically pure joints between longitudinal bars 10, 11 of frame 9 and cross-bars 16, 19 and also to hold clear the cavities of the end portions of longitudinal bars 10, 11 up to a certain depth, in order to have enough space for introducing connecting links, as will be explained hereinafter.

Framework 2 is supported by only two legs 22, 23 which are welded to the undersides of longitudinal bars 20, 21 and which, for improving the steadiness of framework 2, are provided with foot bars 24, 25 extending in the longitudinal direction. It is important to provide legs 22, 23 always, at least approximately, in the plane of the cross-bars 16, 18 and to join them additionally to the cross-bars by means of braces 26, 27.

Figure 6:
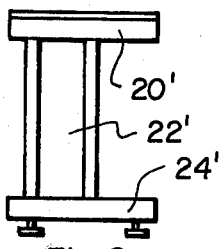
FIGS. 6, 7 and 8 are partial side elevational views of different embodiments of leg supports.
Figure 7:
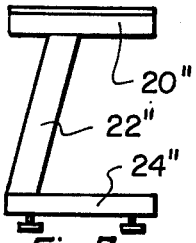
Figure 8:
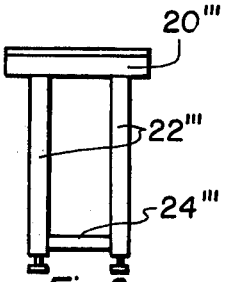

In the embodiment of FIGS. 2 and 3, legs 22 and 23 are made of the same shapes as cross-bars 16 and 18 and extend vertically. It is possible, however, to design the legs differently, for example, as shown in FIGS. 6, 7 and 8, if another appearance is desired. In any case, due to the particular frame structure shown in FIG. 2 and the static connection between the rectangular frame 9 and the two metal tube frames 14 and 15 as well as to the braces 26, 27, the subassembly is so stable that no more than two legs are needed, if only the stability is taken into consideration.

FIG. 2 also shows that outer longitudinal bars 20, 21 extend beyond cross-bars 16, 18 or, in other words, that both cross-bars 16, 18 are disposed inwardly of the ends of longitudinal bars 20, 21, in the same direction. The reason for this is to obtain an equi-distant spacing of cross-bars 16, 17, 18 and 19 in the longitudinal direction of frame 9 and, thereby, favorable static conditions for the entire structure is effected.

Box-like case 5 is secured to rectangular frame 9, and desk plates 3 and 4 are secured to cross-bars 16, 17, 18, 19, in a conventional manner by screws (not shown).

To connect and assemble a plurality of subassemblies, shown in FIG. 2, to a row of working places in accordance with FIGS. 1 or 3, each of cross-bars 12, 13 of rectangular frame 9 is provided with two bores 26, 27 so that each bar 12 of one of the subassemblies can be connected to the respective bar 13 of the other subassembly by means of bolts 28 and nuts 29, as shown in FIG. 5. To obtain a higher vertical stability in the joints between every two assembled units, i.e., subassemblies shown in FIG. 2, it is provided, in addition to the bolted connections shown in FIG. 5, to insert connecting rods 30 into the respective abutting end portions of two longitudinal bars 10, 11 of rectangular frame 9, which rods fit the cavities of longitudinal bars 10, 11 and project therein to approximately 15 to 20 cm.

In a row of working places formed of a plurality of subassemblies according to FIG. 2 and shown in FIGS. 1 and 3, rectangular frames 9, with the box-like cases 5 thereon, form a continuous, straight, table strip 31 to which working or typewriter desks 32, 33 are joined in alternately offset and spaced relationship, with the whole assembly supported only by legs 22 and 23 which are disposed below longitudinal bars 20, 21 of metal tube frames 14, 15. The stability of such a row of working places is so great that the structure can easily withstand the weight of a student or even adult sitting thereon, without deflecting even by millimeters. FIG. 1 also shows that the interior spaces 7 and 8 of the box-like case 5, intended for receiving tape recorders 34 or other phono devices are each associated with the respective seat 35, 36 in front of the working or typewriter desk 32, 33 corresponding to the location in the longitudinal direction.

Instead of legs in the design shown in FIGS. 2 to 8, it is also possible to provide legs having a wide rectangular cross-section and extending below longitudinal bars 20, 21, or, close thereto, below cross-bars 16, 18. A particularly good appearance is thereby obtained.

In the embodiment of FIG. 6, the vertical leg 22' is elongated in a longitudinal direction and it extends between a top of a foot or support 24' is the bottom of a top support 20' forming a part of the frame 14.

The construction of FIG. 7 includes an angled leg 22'' arranged between the frame member 20'' and the bottom leg support 24''.

In the embodiment of FIG. 8, two legs 22''', 22''', are arranged between the frame member 20''' and a cross-base member 24'''.

While specific embodiments of the invention have been shown and described in detail to illustrate the application of the principles of the invention, it will be understood that the invention may be embodied otherwise without departing from such principles.

What is claimed is:

1. A work desk construction particularly for typists, comprising a longitudinally extending rectangular first support frame having a pair of longer sides joined by a pair of narrow edges and defining a flat top case support, second and third laterally offset transverse frames each having a pair of longer sides joined by a pair of narrow edges and connected into said first frame at spaced locations from each longitudinal end of said first frame and extending transversely outwardly in respective opposite directions from said first frame at longitudinally offset locations with the longer sides of said second and third transverse frames extending substantially parallel to said first support frame narrow edges, a support leg connected to each of said second and third transverse frames adjacent the outer transverse ends thereof and comprising the sole support for all of said frames, a box-like case of substantially the same dimensions as said first frame supported on said first frame, and a desk plate of substantially the same dimensions as the portion of said transverse frames which extend laterally outwardly from said longitudinal frames overlying and supported upon respective ones of said laterally outwardly extending portions of said transverse frames.

2. A work desk construction, according to claim 1, wherein each end of said longitudinal frame is provided with means for coupling the adjacent longitudinal end of a next adjacent frame of another unit thereto.

3. A work desk construction, according to claim 1, wherein said longitudinal frame includes an angle member adjacent each end of said frame having an opening therethrough for bolting said angle member to a similar frame positioned alongside it.

4. A work desk construction, according to claim 1, wherein said support leg includes a vertical leg portion and a horizontally extending foot portion adjacent the lower end of said leg portion.

5. A work desk construction, according to claim 1, wherein said leg support comprises a longitudinally widened support leg, a longitudinally extending foot portion secured to the bottom of said support leg.

6. A work desk construction, according to claim 1, wherein said support leg includes an obliquely extending vertical member and a horizontally extending foot portion connected to the lower end of said oliquely extending vertical member.

7. A work desk construction, according to claim 1, wherein said support leg includes two longitudinally spaced support legs and a horizontally extending brace member connected between said support legs.

8. A work desk construction, according to claim 1, wherein said longitudinal frame includes a side member at each side which is of hollow tubular construction, at least one additional unit arranged alongside said first unit including a rectangular longitudinally extending first support frame having longitudinally extending hollow side members on each side of a size comparable to the side members of the next adjacent unit, and a rod member disposed in the hollow side members of each side of said longitudinal frame and interconnecting said units together.

9. A work desk construction, according to claim 8, including a brace extending between said leg support and a side member of said transverse frame, said transverse frame being elongated in a longitudinal direction.

10. A work desk construction, according to claim 9, wherein said transverse frames each include a transverse end member at the outside ends thereof which extend beyond an adjacent side member of said frame in a direction away from the opposite side member.

11. A work desk construction, according to claim 1, wherein said second and third transverse frames each comprise side frame members on each side which extend through and are connected to an adjacent side of said first support frame and are connected to the opposite side of said first support frame.

12. A work desk construction, according to claim 11, wherein said one of said side frame members of said second and third transverse frames has a cross-section with unequal sides and is positioned so that the wide side of its cross-section extends in a horizontal plane, all of said transverse frame side members being welded to the side members of said first support frame.

* * * * *